US009228297B2

(12) United States Patent
Coats

(10) Patent No.: US 9,228,297 B2
(45) Date of Patent: Jan. 5, 2016

(54) RAIL SUPPORT ASSEMBLY WITH IMPROVED SHOULDER

(71) Applicant: Frank Howard Coats, Thorofare, NJ (US)

(72) Inventor: Frank Howard Coats, Thorofare, NJ (US)

(73) Assignee: PANDROL LIMITED, Surrey (GB)

( * ) Notice: Subject to any disclaimer, the term of this patent is extended or adjusted under 35 U.S.C. 154(b) by 121 days.

(21) Appl. No.: 13/687,403

(22) Filed: Nov. 28, 2012

(65) Prior Publication Data

US 2014/0144999 A1 May 29, 2014

(51) Int. Cl.
*E01B 13/02* (2006.01)
*E01B 9/44* (2006.01)

(52) U.S. Cl.
CPC ..... *E01B 9/44* (2013.01)

(58) Field of Classification Search
CPC ..... E01B 9/00; E01B 9/02; E01B 9/38; E01B 9/40; E01B 9/42; E01B 9/60
USPC ..... 238/310, 315–321
See application file for complete search history.

(56) References Cited

U.S. PATENT DOCUMENTS

| | | | | |
|---|---|---|---|---|
| 2,076,019 | A | | 5/1932 | Fifield |
| 3,311,331 | A | | 3/1967 | Steimen |
| 4,047,663 | A | | 9/1977 | Reynolds et al. |
| 4,155,507 | A | | 5/1979 | Chierici et al. |
| 4,307,837 | A | * | 12/1981 | Leingang ..... 238/282 |
| 4,316,578 | A | | 2/1982 | Reynolds et al. |
| 4,572,431 | A | | 2/1986 | Arato |
| 4,648,554 | A | | 3/1987 | McQueen |
| 5,022,584 | A | | 6/1991 | Sherrick |
| 5,110,046 | A | | 5/1992 | Young |
| 5,261,599 | A | | 11/1993 | Brown |
| 5,330,165 | A | | 7/1994 | Van Goubergen |
| 5,335,850 | A | | 8/1994 | Igwemezie |
| 5,405,081 | A | | 4/1995 | Bosshart |
| 5,520,330 | A | | 5/1996 | Brown et al. |
| 5,549,245 | A | | 8/1996 | Kish et al. |
| 5,551,633 | A | | 9/1996 | Kish et al. |
| 5,566,882 | A | | 10/1996 | Brown et al. |
| 5,735,458 | A | | 4/1998 | Brown et al. |
| 6,045,052 | A | | 4/2000 | Besenchek |
| 6,386,461 | B1 | | 5/2002 | Wildgoose |
| 7,080,791 | B2 | | 7/2006 | Geissele et al. |
| 7,690,584 | B2 | | 4/2010 | Geissele et al. |
| 8,286,891 | B2 | | 10/2012 | Cox |

* cited by examiner

*Primary Examiner* — R. J. McCarry, Jr.
(74) *Attorney, Agent, or Firm* — Gottlieb, Rackman & Reisman, P.C.

(57) ABSTRACT

A rail support assembly for mounting and supporting the rail of a railroad system, the assembly including a plate disposed under the rail and including a shoulder hole, a shoulder arranged and constructed to fit in said shoulder hole without rotation with respect to the plate, and a clip having an end received by said shoulder and arranged to bias the rail toward the plate.

17 Claims, 4 Drawing Sheets

RAIL SUPPORT ASSEMBLY WITH IMPROVED SHOULDER

RELATED APPLICATIONS

None

FIELD OF INVENTION

This invention pertains to a rail support assembly including a shoulder and a clip engaging the shoulder and arranged to hold a rail in place, the shoulder being shaped to prevent it from rotating with respect to a supporting plate.

DESCRIPTION OF THE PRIOR ART

Trains running on rails are the most efficient way of transporting all industrial, agricultural as well as consumer products. Typically rails are supported on ties by support assemblies including a bottom plate disposed on ties, a pair of shoulders disposed on top of the plate on either side of a rail and clips made of a steel bar formed into a predetermined shape and arranged to secure the rail. One end of each clip engages a respective shoulder and the rest of the clip rests on top of a rail flange and biases the flange (and therefore the rail) downward toward the plate.

This assembly has been found to be working reasonably well, however one problem with it is that typically railroad cars are extremely heavy and apply tremendous pressure and torsional forces on the rails, especially when rails curve. As a result, sometimes whole sections of rails separate from the ties because the support assemblies are not able to resist these effects.

The present invention provides a solution to this problem.

SUMMARY OF THE INVENTION

A rail support assembly for supporting a rail of a railroad track constructed in accordance with this invention includes a plate having a shoulder hole, a shoulder having a boss sized and shaped to fit through said shoulder hole, the boss and shoulder having matching non-rotational shapes selected to prevent the shoulder to rotate with respect to said plate, the plate having a clip receiving member; and an elastic clip having a first end received in the clip receiving member and a rail retaining portion, the elastic clip being positioned by the shoulder to retain the rail on the plate.

In one aspect of the invention, the railroad track includes a tie and The plate includes a mounting member mounting the plate on the tie.

In one aspect of the invention, the plate includes spike holes receiving spikes to attach said plate to said tie.

In one aspect of the invention, the boss and the shoulder hole have a generally square shape with rounded corners.

DETAILED DESCRIPTION

Figure 1:
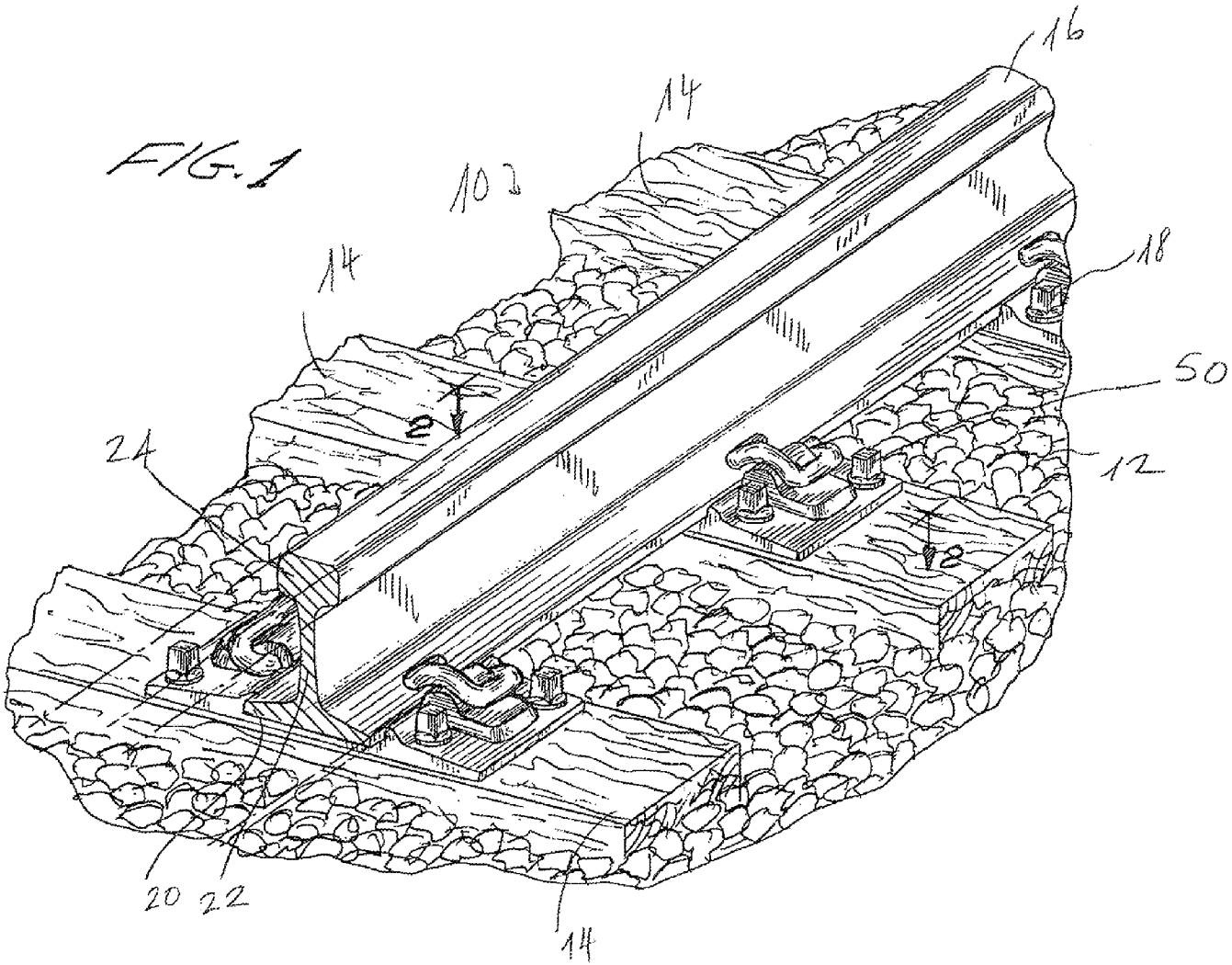
FIG. 1 shows an isometric view of a section of a rail and its supports.

Referring first to FIG. 1, a railroad track 10 includes a track bed 12 with a plurality ties 14. Ties 14 are typically made of treated wood, or concrete. A rail 16 is supported on the ties 14 by a support assembly 18. The rail 16 includes a bottom flange 20, a vertical web 22 and a top 24. A second rail identical to rail 16 extends in parallel thereto but has been omitted for the sake of clarity.

Figure 2:
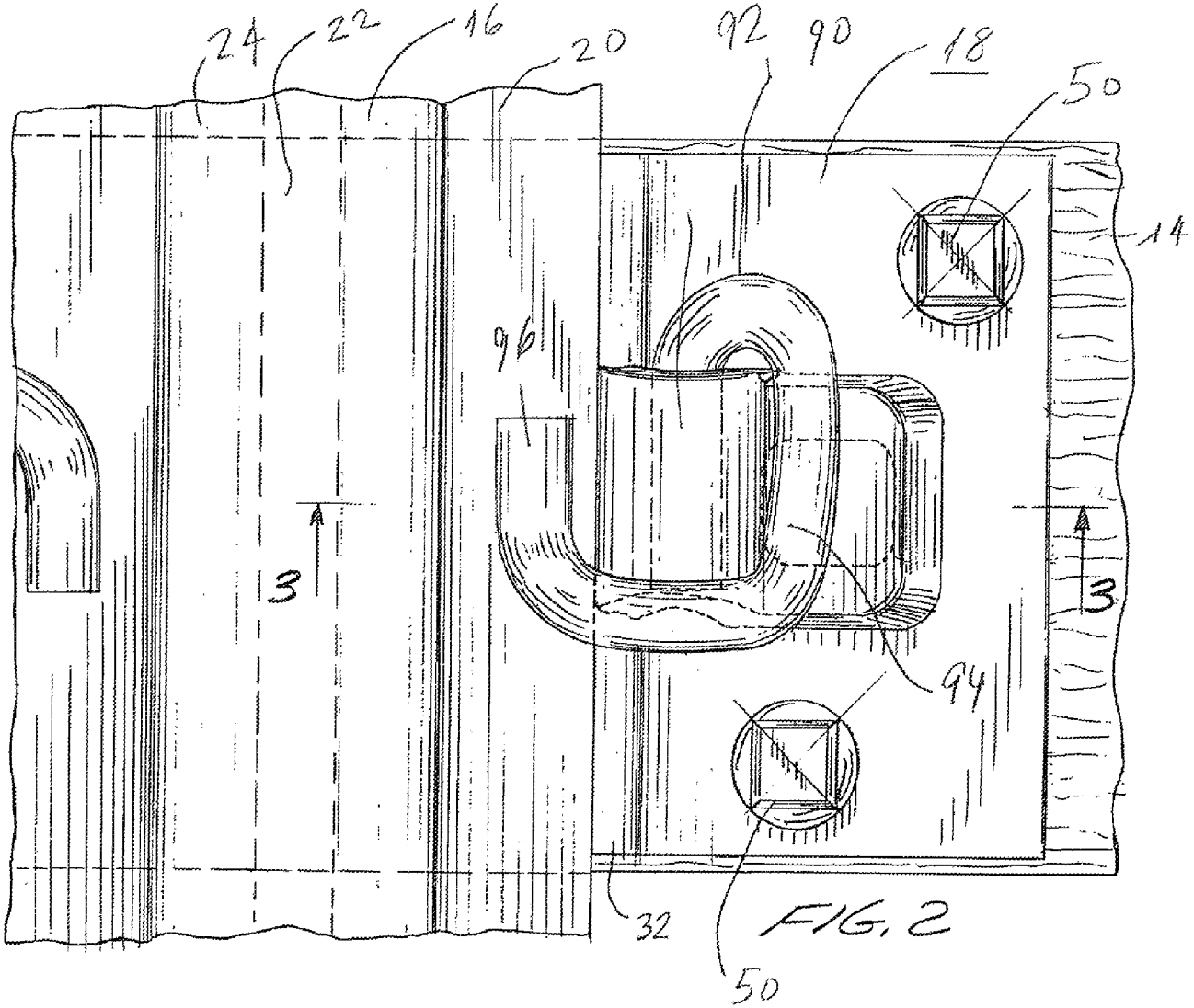
FIG. 2 shows a top view of a rail support assembly constructed in accordance with this invention.
Figure 3:
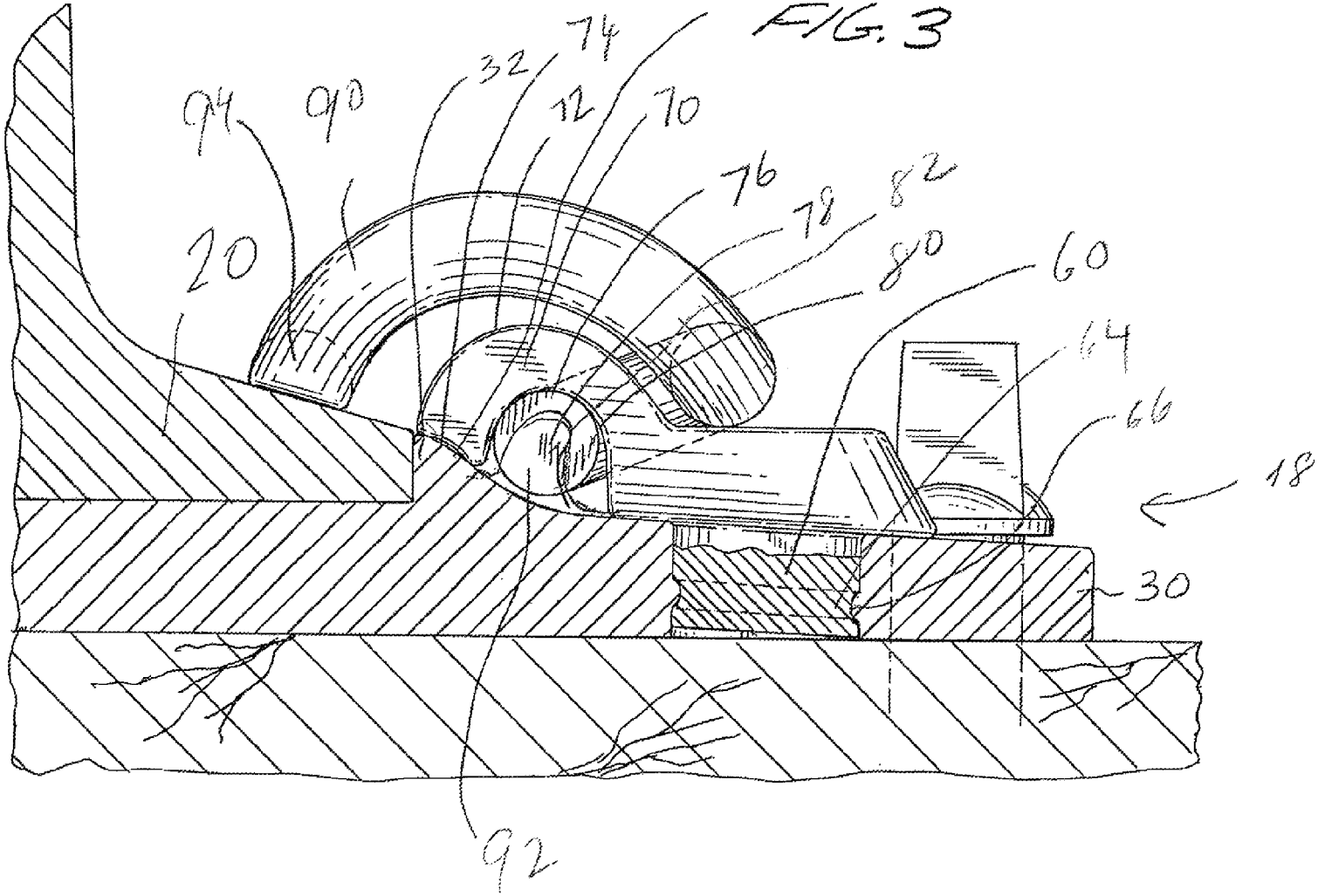
FIG. 3 shows a side sectional view of the rail support assembly.
Figure 4:
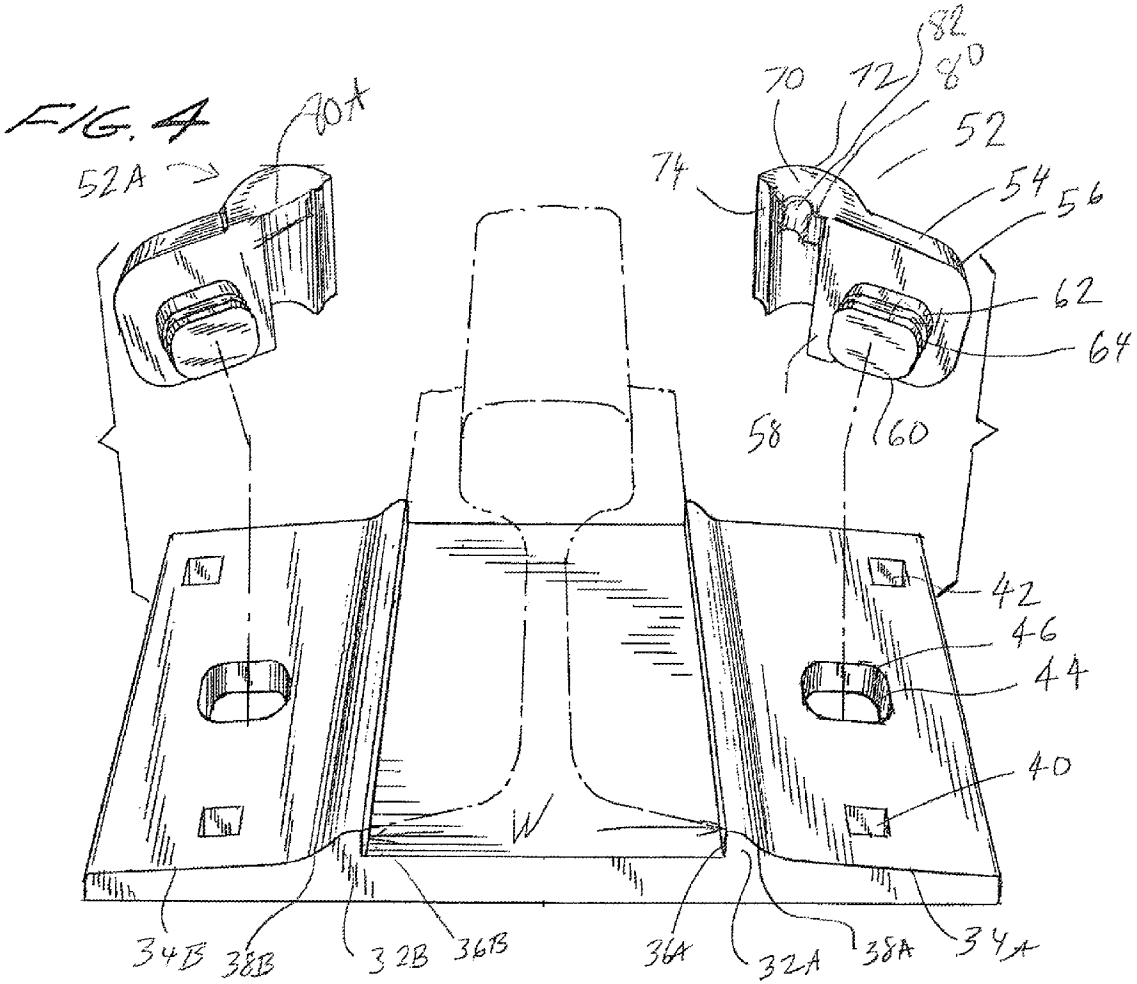
FIG. 4 shows an exploded view of the rail support assembly.

As shown more clearly in FIGS. 2-4, rail support assembly 18 includes a plate 30. Plate 30 is generally rectangular having a width substantially equal to the width of tie 14 and extending along the top surface of the tie 14. The plate 30 is formed with two transversal ridges 32A 32B. Each ridge includes a vertical wall 36A, 36B and a sloping wall 38A, 38B. The distance between the two vertical walls 36A, 36B is equal to the width W of the flange 20 of rail 16. Therefore the rail 16 can be seated solidly on top of the plate 18 with the flange 20 firmly seated between the ridges 32A, 32B.

Optionally, a pad (not shown) may be provided between the rail 16 and the plate 30.

The plate 20 has two segments 34A, 34B disposed between the ridges 32A, 32B and the short edges of the plate 20 as shown. Segment 34A is formed with two smaller holes 40, 42 and a large hole 44. Importantly, large hole 44 has a generally square shape with rounded corners, as at 46.

Referring back to FIG. 2, four conventional spikes 50 pass through holes 44 and secure the assembly 18 to the tie 14.

Attached to plate 30 is a shoulder 52. This shoulder 52 includes a base 54 having a somewhat square configuration with sloping sides, as at 56. The base 54 also has a flat bottom surface 58 with a boss 60 extending downwardly from the surface 58. The boss 60 has the same shape and size as hole 44. The boss 60 has an outer surface with a circumferential groove 64.

The shoulder 52 further includes a clamping wall 70 having a somewhat cylindrical outer surface 72 terminating in a sloping edge 74. The clamping wall 70 is sized and shaped so that when the shoulder 52 is attached to the plate 18, the slopping edge 74 abuts an upper portion of sloping wall 38A on the plate. The clamping wall 70 also includes an inner surface 76. This inner surface 76 has a partial cylindrical shape and forms with wall 38A a horizontal hole 78.

In one embodiment, the clamping wall 70 is provided with an end portion 80 on the inner surface 76. The end portion 80 is formed with a semicircular cutout 82. This cutout forms an opening 84 for hole 78.

In an alternate embodiment, shoulder 52A (also shown in FIG. 4, end portion 80A extends across inner surface 76A so when the shoulder is attached to the plate, there is no opening into the hole 78.

Assembly 18 further includes a clip 90. The clip 90 has one end 92 that is straight, an intermediate portion 94 and another straight portion 96. The clip 90 preferably has a constant cross section. Its first end 90 is sized and shaped to fit into the hole 78 as shown. In this position, the rest of the clip is positioned so that its other end 94 biases the flange 20 downwardly towards the plate 18. The clip 90 is made of steel or other high strength, somewhat flexible material to insure that the rail is firmly attached to the tie 12 through assembly 18. The flexibility of the clip 90 allows the rail to move up and down slightly as a car goes by on the rail 16. In the embodiment on the right side of FIG. 3 rocks or other undesirable objects trapped in hole 78 are pushed out through opening 84.

The shoulder 52 is preassembled with the plate 20, for example by press-fitting the boss 62 through hole 44. During this operation, pressure is also applied to the bottom portion of the plate 20 causing some of the material of the plate 20 to enter into and even fill slot 64, as shown at 66 in FIG. 3. As a result, the shoulder 52 is firmly mounted and secured to plate 20 and cannot be dislodged easily. Moreover, because the boss 60 and hole 44 are both non-circular, the boss does not rotate with respect to plate 20 but remains firmly attached to it even while the assembly is subjected to extremely high pressures and torsional forces due to a train of several wheels passes by. Since the shoulder is securely mounted, the clip 90 is secured and remains secured to the plate 20 and will not rotate even under strong forces thereby permanently engaging clip 90, and therefore the rail 16.

Numerous modifications may be made to the invention without departing from its scope as defined in the appended claims.

I claim:

1. A rail support assembly for supporting a rail of a railroad track comprising:

a plate having a shoulder hole;

a shoulder having a boss sized and shaped to fit through said shoulder hole and secure said shoulder to said plate, said boss and shoulder hole having matching non-rotational shapes selected to prevent said shoulder to rotate with respect to said plate, said plate and said shoulder cooperating to define a clip receiving member; and a clip having a first end received in said clip receiving member, said clip being configured to retain the rail on said plate;

wherein said plate has a top surface and a bottom surface and said shoulder is permanently mounted on said plate with said boss extending through said shoulder hole from said top surface without protruding below said bottom surface.

2. The assembly of claim 1 wherein the railroad track includes a tie and said plate includes a mounting member mounting said plate on the tie.

3. The assembly of claim 2 wherein said plate includes spike holes receiving spikes to attach said plate to said tie.

4. The assembly of claim 1 wherein said boss and said shoulder hole have a generally square shape with rounded corners.

5. The assembly of claim 1 wherein said shoulder and plate are permanently attached.

6. The assembly of claim 1 wherein said boss is press fit into said shoulder hole.

7. The assembly of claim 1 wherein said boss has a peripheral surface formed with a groove and wherein said boss is press fit into said shoulder hole with a portion of said plate extending into said groove to capture said boss permanently.

8. The assembly of claim 1 wherein said plate has a plate thickness and said boss has a length shorter than said plate thickness.

9. A shoulder for retaining a rail on a plate in a railroad transportation system, using a clip arranged to abut and bias the rail against the plate, said plate having a top surface and a bottom surface and a shoulder hole having a non-rotational cross sectional shape and extending between said top and bottom surface, said shoulder comprising:

a boss having a cross sectional shape matching the shape of the shoulder hole, said boss being sized to fit into said shoulder hole without extending beyond said bottom surface and being configured to mount said shoulder onto the plate; and a clip retaining member coupled to said boss and arranged to bias the rail against the plate by said clip retaining member;

wherein said boss has an outer surface and a groove formed at least partially around said outer surface, said groove being sized and shaped to receive some material from the plate when the shoulder is press fit into the shoulder hole.

10. The shoulder of claim 9 wherein said clip retaining member is cooperating with the plate to define a clip receiving opening to receive an end of the clip.

11. The shoulder of claim 9 wherein the plate includes at least one ridge with a sloping wall and the clip retaining includes a clamping wall cooperating with the sloping wall to form a clip receiving hole.

12. The shoulder of claim 11 wherein said clamping wall includes a member defining an exit hole from said clip receiving hole.

13. A railroad support assembly supporting a continuous rail on a railroad tie, said railroad support assembly comprising:

a plate having a top and a bottom surface with two ridges extending across the top surface for receiving the rail, said plate having a shoulder hole disposed at a predetermined distance from one of said ridges;

a clip configured to bias the rail against said plate, said clip having a clip end; and at least one shoulder having a first shoulder end and a second shoulder end, said shoulder being formed with a boss spaced away from said first shoulder end and adjacent to said second shoulder end, said boss extending downwardly into said shoulder hole, said plate and first shoulder end cooperating to form a clip receiving space for receiving said clip end, said boss and shoulder hole having matching non-rotational shapes selected to prevent said shoulder from rotating with respect to said plate, said boss and said plate cooperating to permanently capture said boss within said shoulder hole;

said plate having a plate thickness around said shoulder hole and said boss has a longitudinal length smaller than said plate thickness so that when said boss is inserted into said shoulder hole, said boss does not extend out of said shoulder hole.

14. The assembly of claim 13 wherein said shoulder hole and said boss having the same sized square cross sections.

15. The assembly of claim 13 wherein said shoulder hole and said boss having the same sized square cross sections with rounded corners.

16. The assembly of claim 13 wherein said boss is press fit into said shoulder hole.

17. The assembly of claim 13 wherein said boss has a circumferential wall with a groove with some material from said plate extending into said groove to capture said shoulder.

* * * * *